US012181232B2

(12) United States Patent
Jin et al.

(10) Patent No.: US 12,181,232 B2
(45) Date of Patent: Dec. 31, 2024

(54) HEADER ASSEMBLY AND HEAT EXCHANGER

(71) Applicant: Danfoss A/S, Nordborg (DK)

(72) Inventors: Huan Jin, Jiaxing (CN); Weijun Wu, Jiaxing (CN)

(73) Assignee: DANFOSS A/S, Nordborg (DK)

( * ) Notice: Subject to any disclaimer, the term of this patent is extended or adjusted under 35 U.S.C. 154(b) by 202 days.

(21) Appl. No.: 18/002,668

(22) PCT Filed: May 27, 2021

(86) PCT No.: PCT/CN2021/096368
§ 371 (c)(1),
(2) Date: Dec. 21, 2022

(87) PCT Pub. No.: WO2021/258980
PCT Pub. Date: Dec. 30, 2021

(65) Prior Publication Data

US 2023/0251046 A1 Aug. 10, 2023

(30) Foreign Application Priority Data

Jun. 23, 2020 (CN) ..... 202021186941.6

(51) Int. Cl.
*F28F 9/013* (2006.01)
*F28D 1/053* (2006.01)
*F28F 9/007* (2006.01)

(52) U.S. Cl.
CPC ..... *F28F 9/013* (2013.01); *F28D 1/05366* (2013.01); *F28F 9/007* (2013.01); *F28F 2275/146* (2013.01)

(58) Field of Classification Search
CPC ..... F28F 9/007; F28F 9/013; F28F 2275/146; F28D 1/05366
(Continued)

(56) References Cited

U.S. PATENT DOCUMENTS 5,509,473 A 4/1996 Tokutake
5,632,332 A * 5/1997 Hanafusa ..... F28F 9/002 165/178
(Continued)

FOREIGN PATENT DOCUMENTS

CN 202709554 U 1/2013
CN 204346209 U 5/2015
(Continued)

OTHER PUBLICATIONS

International Search Report mailed on Jul. 13, 2021, in connection with corresponding International Application No. PCT/CN2021/096368 (7 pp., including machine-generated English translation).

*Primary Examiner* — Joel M Attey
(74) *Attorney, Agent, or Firm* — McCormick, Paulding & Huber PLLC

(57) ABSTRACT

Disclosed in the present invention are a header assembly for a heat exchanger, and a heat exchanger. The header assembly includes: a header, having: a header wall, and a recess on the header wall or an opening penetrating the header wall at an end of the header wall; an end cap disposed at the end of the header wall to close the end of the header, the end cap having a hole, the opening or recess being at a side of the end cap that faces an end face of the end of the header wall; a distribution pipe, comprising a distribution part and a connection part, the connection part projecting from the end cap through the hole of the end cap from the distribution part; and a positioning member having a first end and a second end, the first end of the positioning member being connected to the connection part of the distribution pipe, and the second end of the positioning member being engaged in the opening or recess of the header wall of the header. By using the header assembly and the heat exchanger according to the
(Continued)

embodiments of the present invention, the quality of the heat exchanger may be improved.

17 Claims, 13 Drawing Sheets

(58) Field of Classification Search
USPC ..... 165/67
See application file for complete search history.

(56) References Cited

U.S. PATENT DOCUMENTS

| | | | |
|---|---|---|---|
| 8,408,284 | B2 | 4/2013 | Polisoto et al. |
| 8,516,701 | B2 | 8/2013 | Pautler |
| 10,704,844 | B2 | 7/2020 | Xia et al. |

FOREIGN PATENT DOCUMENTS

| | | | |
|---|---|---|---|
| CN | 104880115 | A | 9/2015 |
| CN | 204830986 | U | 12/2015 |
| CN | 212431901 | U | 1/2021 |
| DE | 69207485 | T2 | 6/1996 |
| JP | 08-219680 | A | 8/1996 |
| JP | H10-141887 | A | 5/1998 |
| JP | 2000-018874 | A | 1/2000 |

* cited by examiner

HEADER ASSEMBLY AND HEAT EXCHANGER

CROSS-REFERENCE TO RELATED APPLICATIONS

This application is a National Stage application of International Patent Application No. PCT/CN2021/096368, filed on May 27, 2021, which claims priority to Chinese Patent Application No. 202021186941.6, filed on Jun. 23, 2020, each of which is hereby incorporated by reference in its entirety.

TECHNICAL FIELD

The embodiments of the present invention relate to a header assembly for a heat exchanger, and a heat exchanger.

BACKGROUND

A heat exchanger comprises a header assembly and heat exchange tubes; the header assembly comprises a distribution pipe and a header, and the heat exchange tubes are connected to the header.

SUMMARY

It is an object of embodiments of the present invention to provide a header assembly for a heat exchanger, and a heat exchanger, whereby, for example, the quality of the heat exchanger may be improved.

The embodiments of the present invention provide a header assembly for a heat exchanger. The header assembly comprises: a header, comprising: a header wall, and an opening penetrating the header wall at an end of the header wall; an end cap disposed in the header wall at the end of the header wall, the end cap having a hole, the opening or recess being at a side of the end cap that faces an end face of the end of the header wall; a distribution pipe, comprising a distribution part and a connection part, the connection part projecting from the end cap through the hole of the end cap from the distribution part; and a positioning member, the positioning member having a first end and a second end, the first end of the positioning member being connected to the connection part of the distribution pipe, and the second end of the positioning member being engaged in the opening or recess of the header wall of the header.

According to an embodiment of the present invention, the first end of the positioning member has a hole or a notch, and the connection part of the distribution pipe is inserted into the hole or notch of the first end of the positioning member.

According to an embodiment of the invention, the opening or recess of the header wall is a notch sunk from the end face of the end of the header wall.

According to an embodiment of the present invention, the positioning member extends in a direction intersecting the axial direction of the header.

According to an embodiment of the present invention, the connection part of the distribution pipe has an opening penetrating a pipe wall of the connection part, and the first end of the positioning member is inserted into the opening of the connection part of the distribution pipe in a direction intersecting the axial direction of the connection part of the distribution pipe.

According to an embodiment of the present invention, the opening of the connection part of the distribution pipe is a notch sunk from an end face of the connection part.

According to an embodiment of the present invention, the connection part of the distribution pipe comprises a first connection part extending in the axial direction of the distribution pipe, and a second connection part which is connected to the first connection part and bent at a predetermined angle relative to the first connection part; and the first end of the positioning member is connected to the second connection part of the connection part of the distribution pipe.

According to an embodiment of the present invention, the positioning member also has an intermediate part between the first end and the second end, and the second end of the positioning member has a bent part which is bent at a predetermined angle relative to the intermediate part of the positioning member, the bent part being engaged in the opening or recess of the header wall of the header.

According to an embodiment of the present invention, the connection part of the distribution pipe comprises a first connection part extending in the axial direction of the distribution pipe, and a second connection part which is connected to the first connection part and bent at a predetermined angle relative to the first connection part; and the header further comprises a slot penetrating the header wall at the end of the header wall, the slot comprising a first slot part sunk from the end face of the end of the header wall, and the second connection part of the distribution pipe is in the first slot part.

According to an embodiment of the present invention, the connection part of the distribution pipe comprises a first connection part extending in the axial direction of the distribution pipe, and a second connection part which is connected to the first connection part and bent at a predetermined angle relative to the first connection part; and the header further comprises a slot penetrating the header wall at the end of the header wall, the slot comprising a first slot part and a second slot part; the second slot part is sunk from the end face of the end of the header wall, and the first slot part extends in a direction intersecting the second slot part from that end of the second slot part which is remote from the end face of the end of the header wall; the first slot part has slot walls opposite each other in the axial direction of the header, and the second connection part of the distribution pipe is in the first slot part.

According to an embodiment of the present invention, the opening or recess of the header wall is a notch sunk from the first slot part in the header wall in a direction away from the end face of the end of the header wall.

According to an embodiment of the present invention, the opening or recess of the header wall is a notch sunk from the second slot part in the header wall in a direction away from the end face of the end of the header wall.

The embodiments of the present invention also provide a heat exchanger, comprising a heat exchange tube, and further comprising the header assembly as described in the above embodiments, an end of the heat exchange tube being connected to the header of the header assembly.

By using the header assembly and the heat exchanger according to the embodiments of the present invention, for example, the quality of the heat exchanger may be improved.

DETAILED DESCRIPTION

Figure 2:
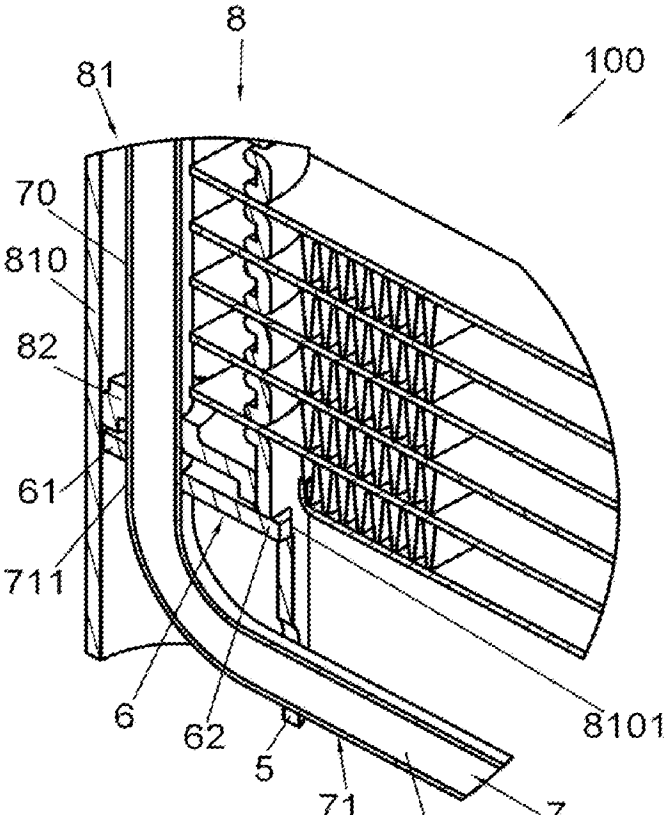
FIG. 2 is a schematic partial enlarged sectional view of the heat exchanger shown in FIG. 1.
Figure 1:
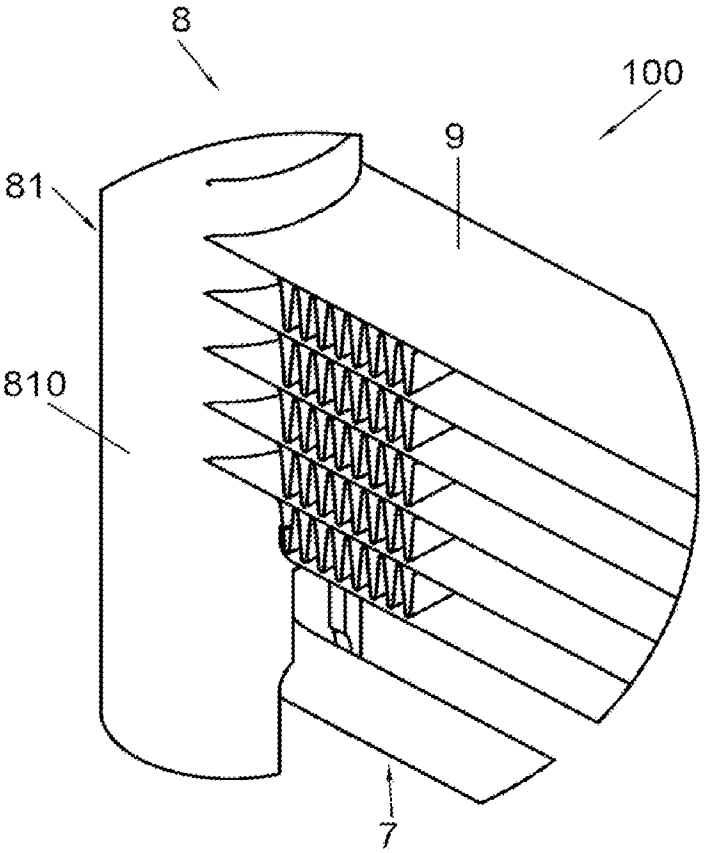
FIG. 1 is a schematic partial enlarged perspective view of a heat exchanger according to a first embodiment of the present invention.
Figure 4:
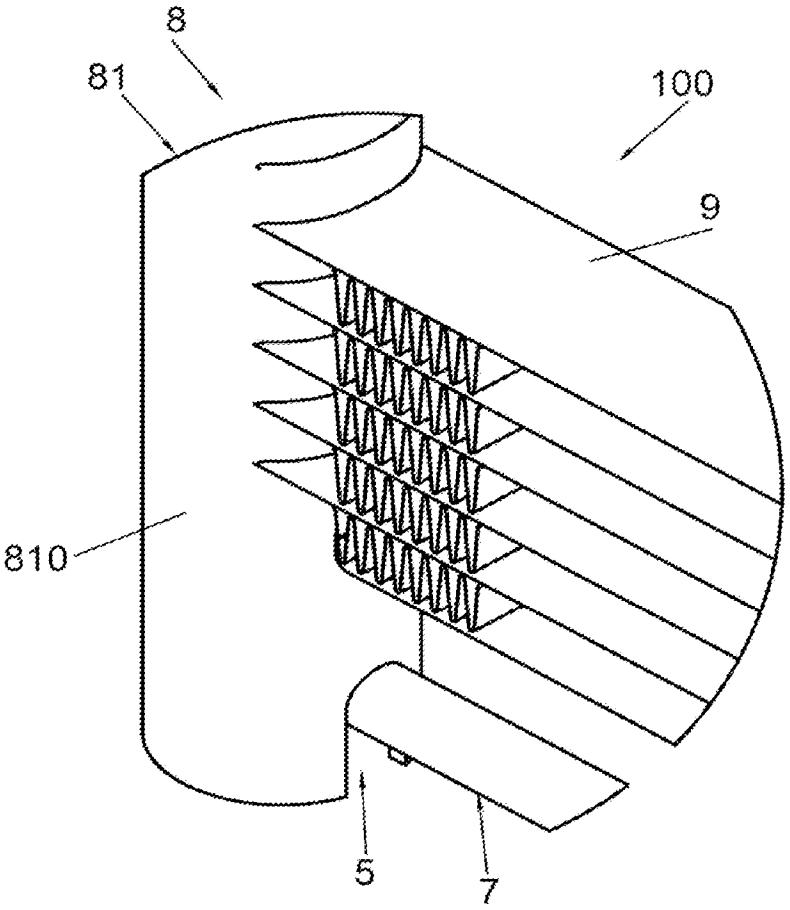
FIG. 4 is a schematic partial enlarged perspective view of a heat exchanger according to a second embodiment of the present invention.

The present invention is explained further below in conjunction with the accompanying drawings and specific implementations.

Referring to FIGS. 1 to 26, a heat exchanger 100 according to an embodiment of the present invention comprises: heat exchange tubes 9; and a header assembly 8, wherein ends of the heat exchange tubes 9 are connected to a header 81 of the header assembly 8. The heat exchanger 100 further comprises fins arranged alternately with the heat exchange tubes 9.

Referring to FIGS. 1 to 26, according to an embodiment of the present invention, the header assembly 8 comprises: a header 81, the header 81 comprising: a header wall 810, and a recess 8101 on the header wall or an opening 8101 penetrating the header wall 810 at an end of the header wall 810; an end cap 82, the end cap 82 being provided at the end of the header wall 810 (for example in the header wall 810) to close the end of the header 81, the end cap 82 having a hole 820, and the opening or recess 8101 being at a side of the end cap 82 that faces an end face of the end of the header wall 810; a distribution pipe 7, the distribution pipe 7 comprising a distribution part 70 and a connection part 71, the connection part 71 projecting from the end cap 82 through the hole 820 of the end cap 82 from the distribution part 70; and a positioning member 6, the positioning member 6 having a first end 61 and a second end 62, the first end 61 of the positioning member 6 being connected to the connection part 71 of the distribution pipe 7, and the second end 62 of the positioning member 6 being engaged in the opening or recess 8101 of the header wall 810 of the header 81.

Referring to FIGS. 2, 5 and 8 to 17, according to an embodiment of the present invention, the first end 61 of the positioning member 6 has a hole or notch 610, and the connection part 71 of the distribution pipe 7 is inserted into the hole or notch 610 of the first end 61 of the positioning member 6. The second end 62 of the positioning member 6 may have a rectangular cross section.

Figure 8:
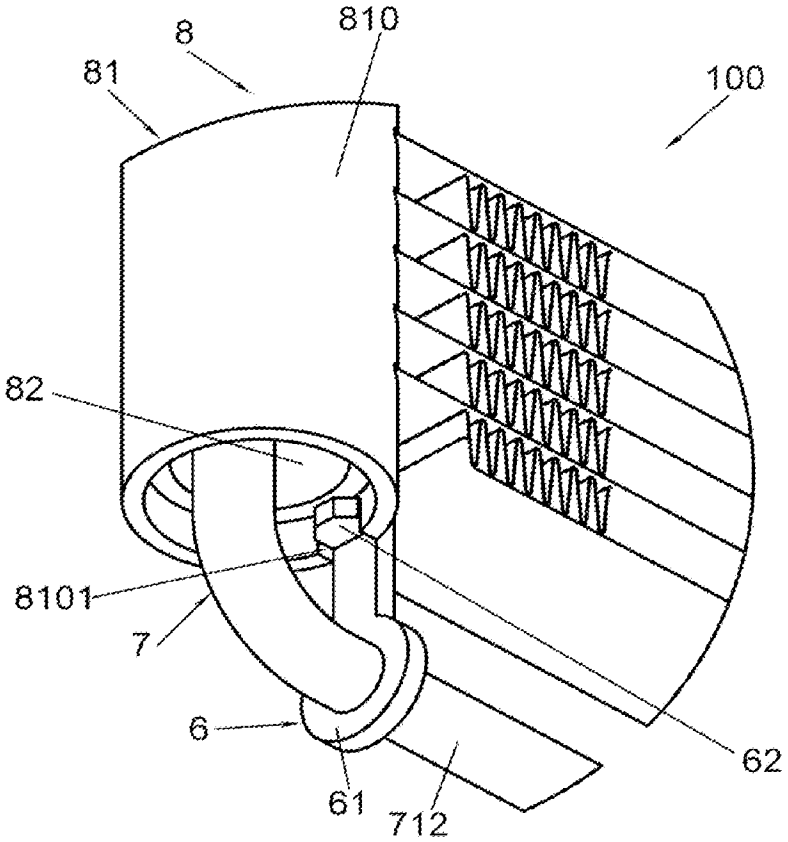
FIG. 8 is a schematic partial enlarged perspective view of a heat exchanger according to a third embodiment of the present invention.
Figure 10:
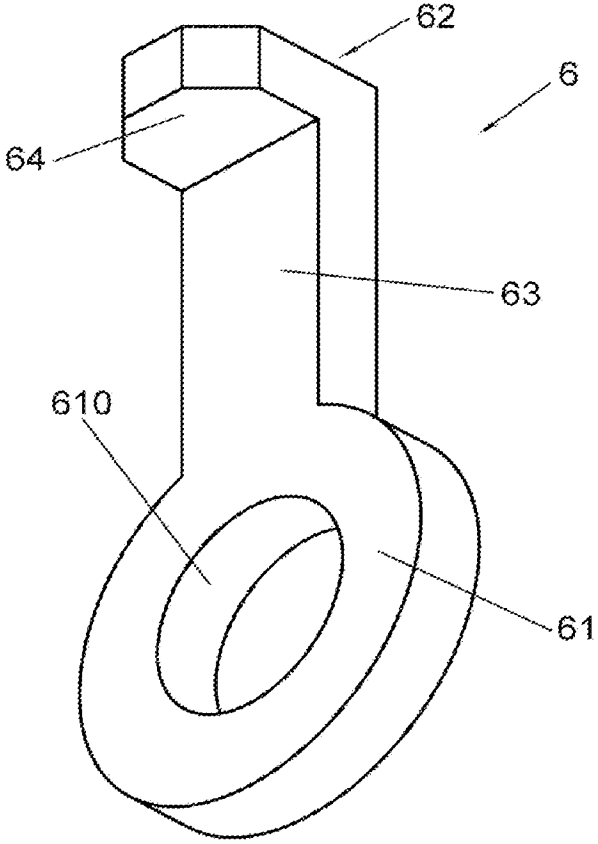
FIG. 10 is a schematic enlarged perspective view of the positioning member of the heat exchanger shown in FIG. 8.
Figure 9:
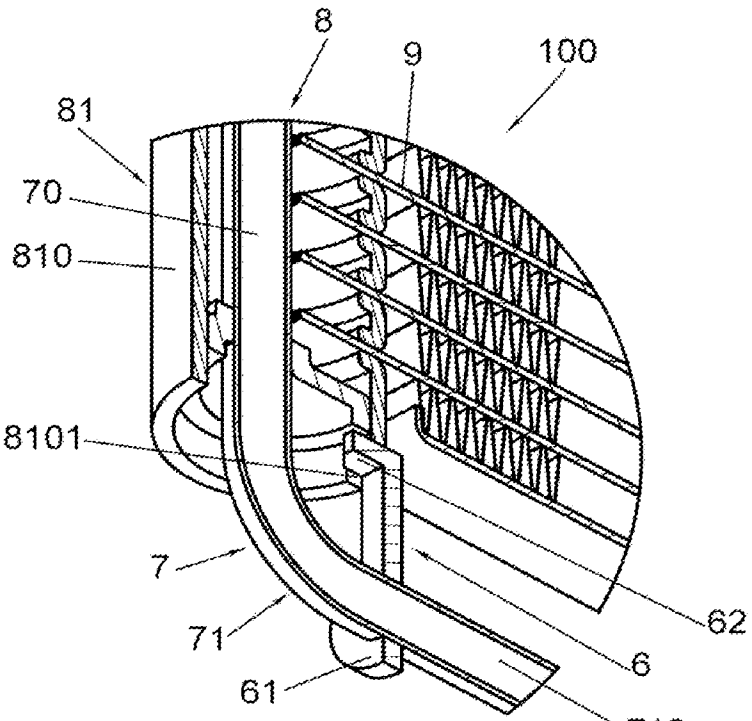
FIG. 9 is a schematic partial enlarged sectional view of the heat exchanger shown in FIG. 8.
Figure 12:
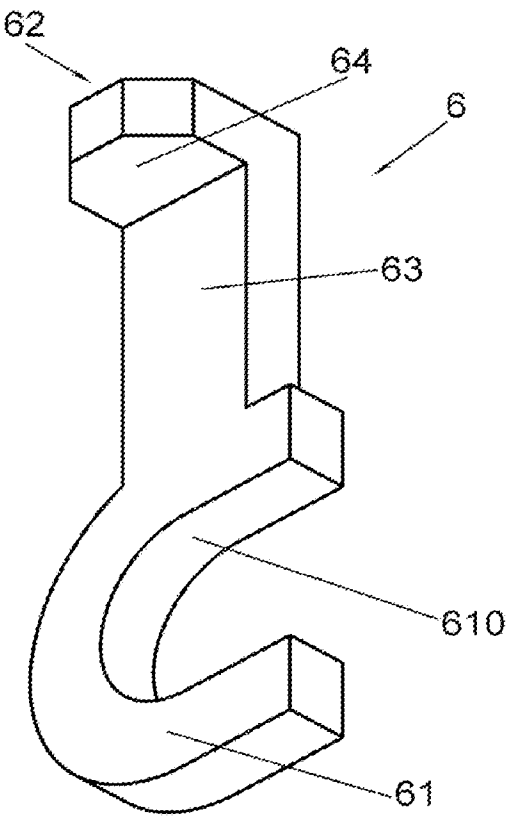
FIG. 12 is a schematic enlarged perspective view of the positioning member of the heat exchanger shown in FIG. 11.
Figure 11:
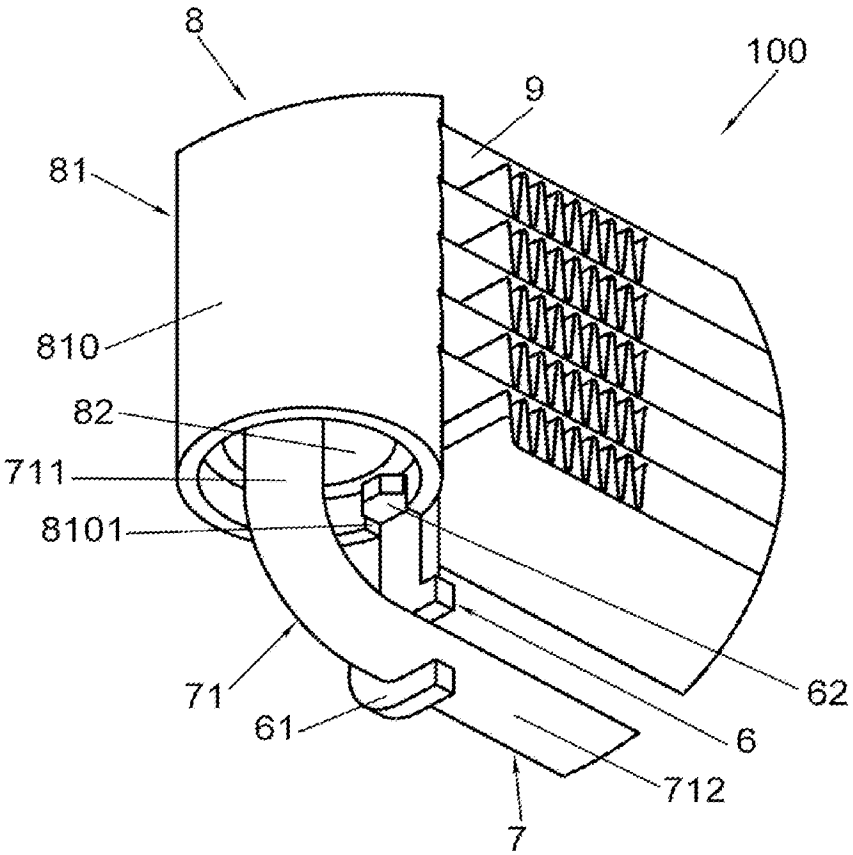
FIG. 11 is a schematic partial enlarged perspective view of a heat exchanger according to an embodiment of the present invention.
Figure 14:
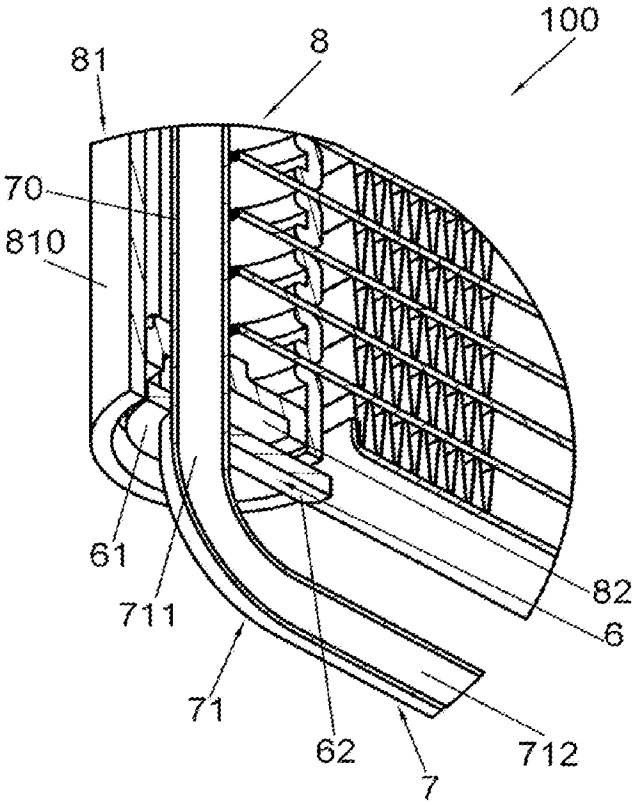
FIG. 14 is a schematic partial enlarged sectional view of the heat exchanger shown in FIG. 13.
Figure 13:
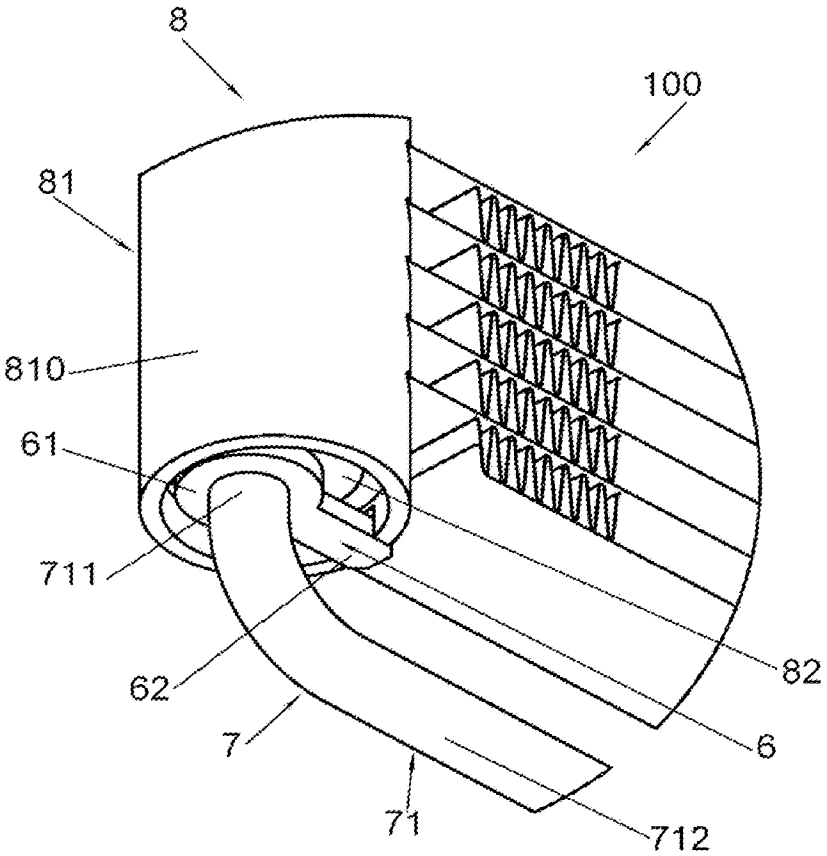
FIG. 13 is a schematic partial enlarged perspective view of a heat exchanger according to a fourth embodiment of the present invention.
Figure 16:
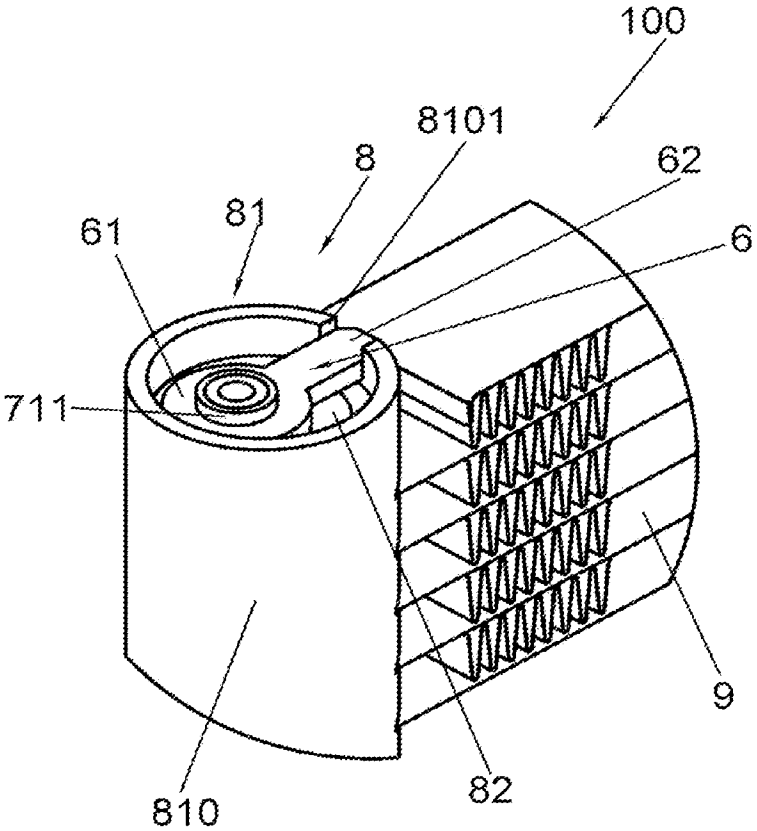
FIG. 16 is a schematic partial enlarged perspective view of a heat exchanger according to a fifth embodiment of the present invention.
Figure 15:
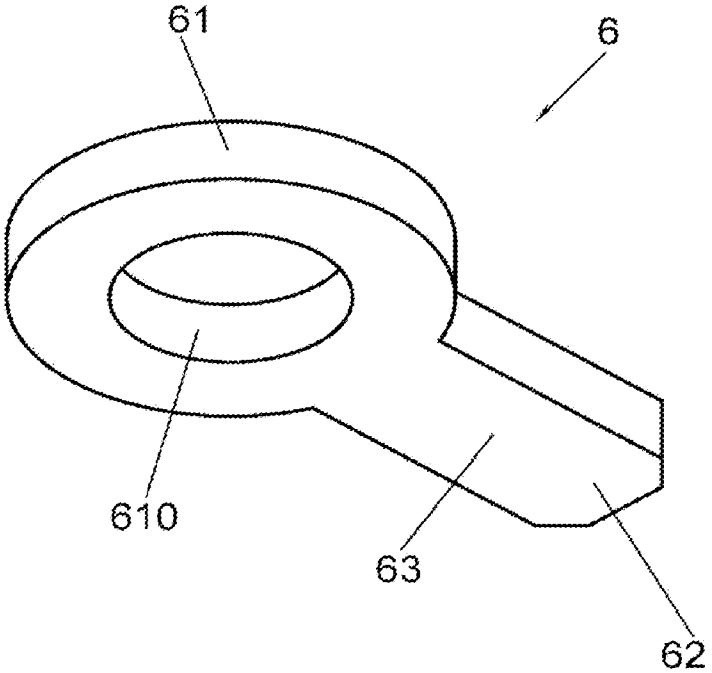
FIG. 15 is a schematic enlarged perspective view of the positioning member of the heat exchanger shown in FIG. 13.
Figure 18:
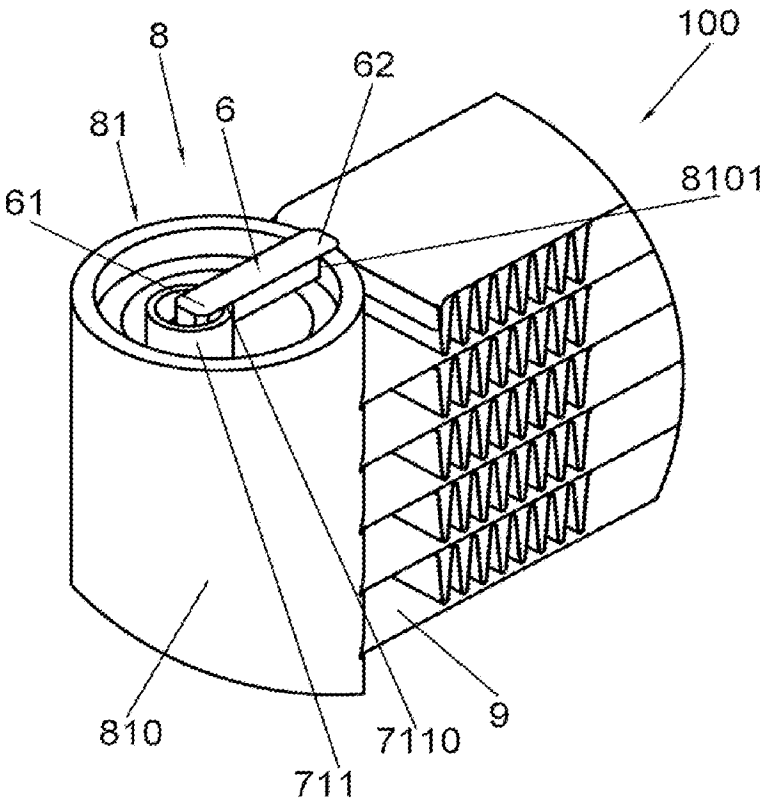
FIG. 18 is a schematic partial enlarged perspective view of a heat exchanger according to a sixth embodiment of the present invention.
Figure 17:
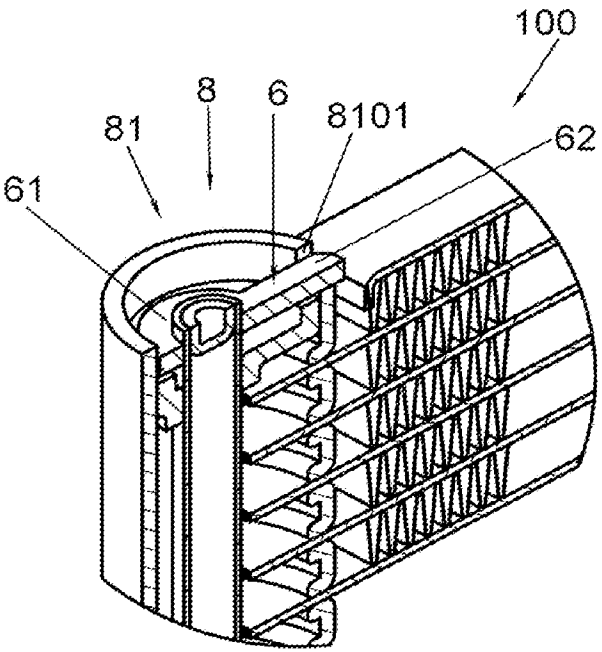
FIG. 17 is a schematic partial enlarged sectional view of the heat exchanger shown in FIG. 16.
Figure 20:
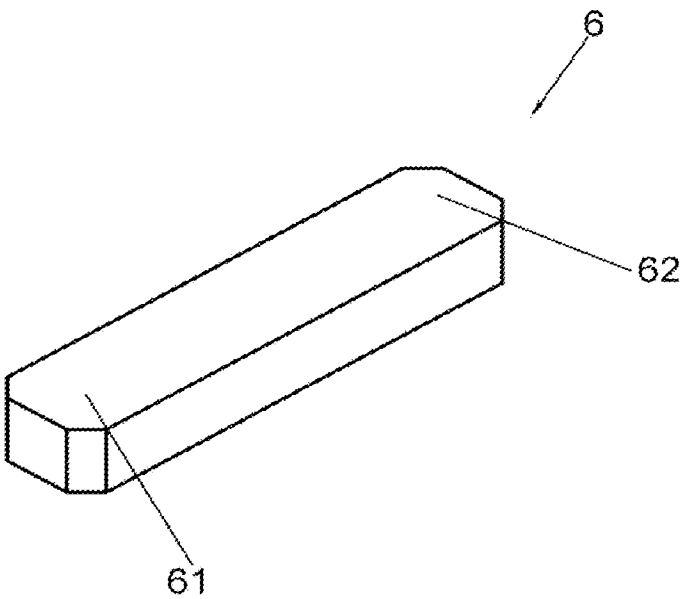
FIG. 20 is a schematic enlarged perspective view of the positioning member of the heat exchanger shown in FIG. 18.
Figure 19:
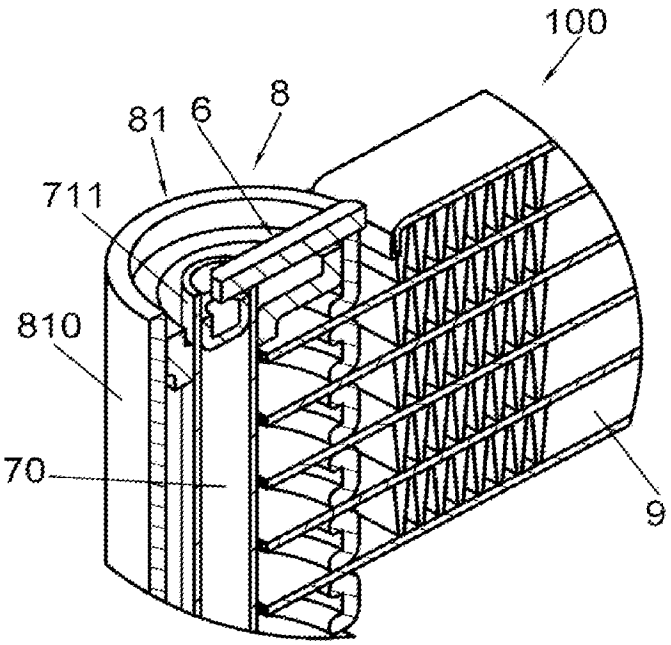
FIG. 19 is a schematic partial enlarged sectional view of the heat exchanger shown in FIG. 18.
Figure 22:
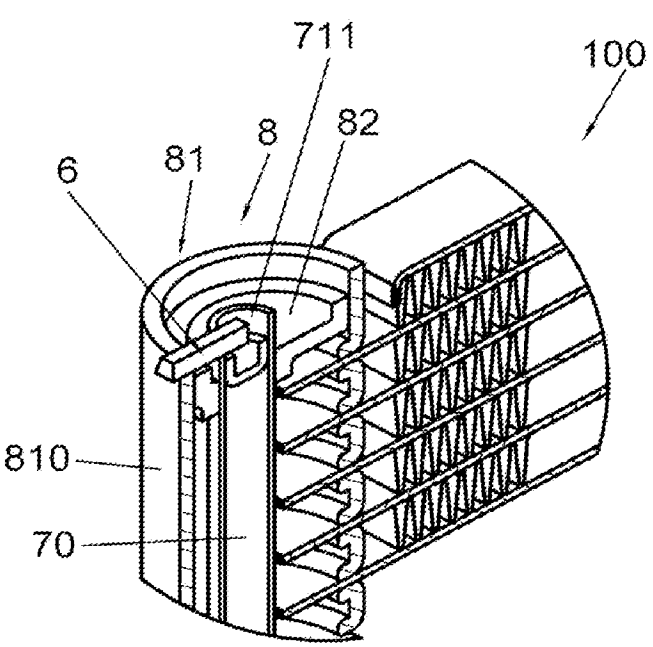
FIG. 22 is a schematic partial enlarged sectional view of the heat exchanger shown in FIG. 21.
Figure 21:
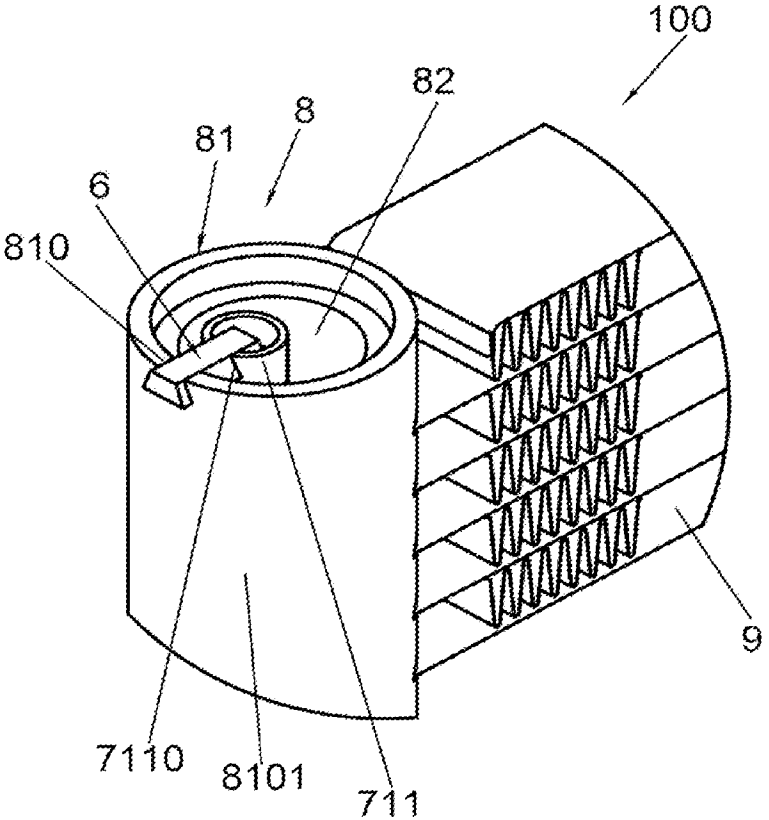
FIG. 21 is a schematic partial enlarged perspective view of a heat exchanger according to a seventh embodiment of the present invention.
Figure 24:
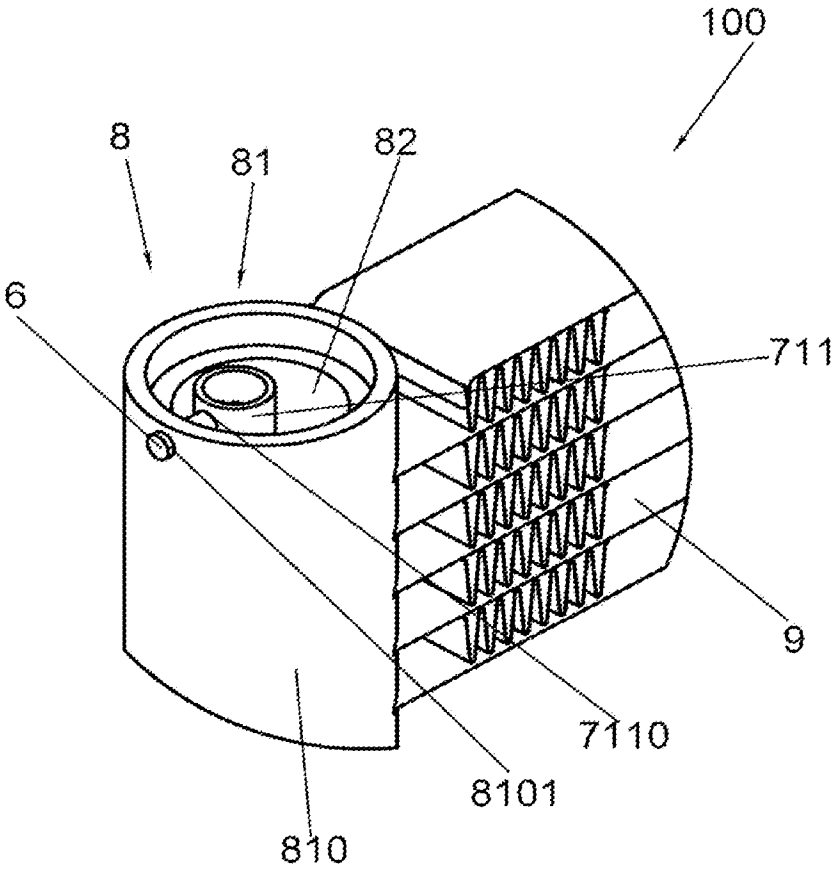
FIG. 24 is a schematic partial enlarged perspective view of a heat exchanger according to an eighth embodiment of the present invention.
Figure 23:
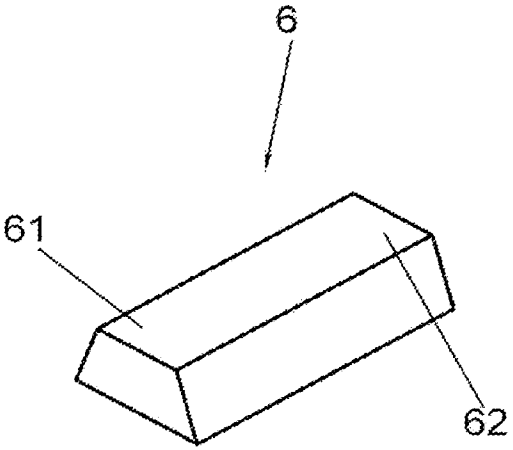
FIG. 23 is a schematic enlarged perspective view of the positioning member of the heat exchanger shown in FIG. 21.
Figure 26:
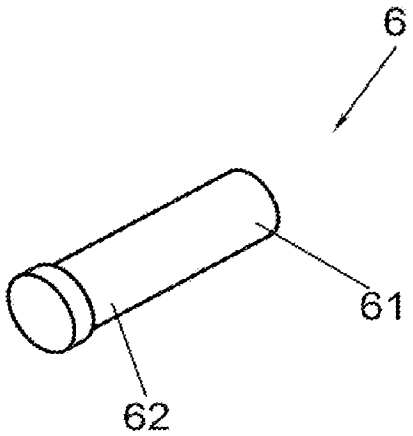
FIG. 26 is a schematic enlarged perspective view of the positioning member of the heat exchanger shown in FIG. 24.
Figure 25:
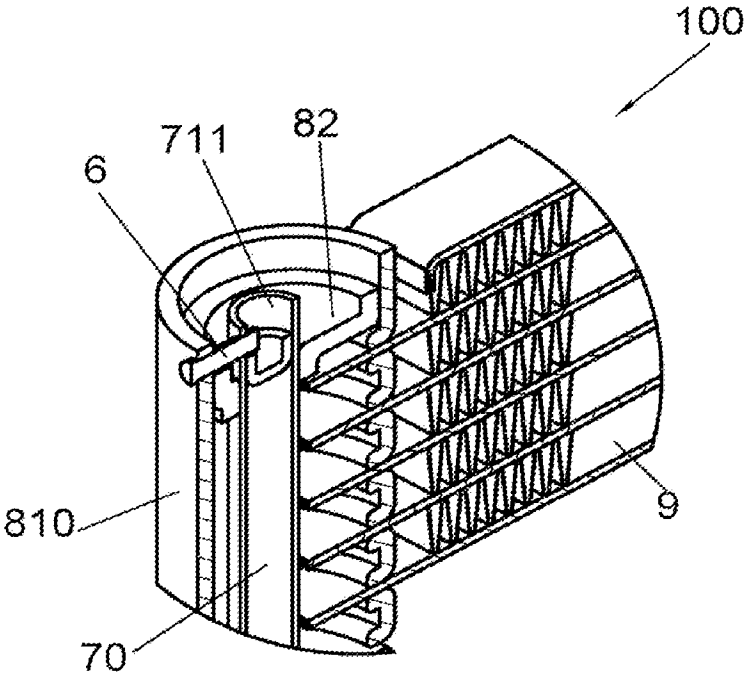
FIG. 25 is a schematic partial enlarged sectional view of the heat exchanger shown in FIG. 24.

FIGS. 8 to 12 show embodiments in which the distribution pipe 7 is positioned in the axial direction of the header 81; FIGS. 8, 9, and 10 show an embodiment in which the first end 61 of the positioning member 6 has a hole, while FIGS. 11 and 12 show an embodiment in which the first end 61 of the positioning member 6 has a notch. For other types of positioning members 6 with a hole in the first end 61, the hole may also be replaced by a notch.

Referring to FIGS. 2, 3, 8, 9, 11, 13, 14, 16 to 19 and 21, according to embodiments of the present invention, the opening or recess 8101 of the header wall 810 is a notch sunk from an end face of the end of the header wall 810.

Referring to FIGS. 2 and 13 to 26, according to embodiments of the present invention, the positioning member 6 extends in a direction intersecting the axial direction of the header 81, thereby positioning the distribution pipe 7 in a radial direction of the header 81.

Referring to FIGS. 18 to 26, according to embodiments of the present invention, the connection part 71 of the distribution pipe 7 has an opening 7110 penetrating a pipe wall 710 of the connection part 71, the positioning member 6 has a rod-like shape, and the first end 61 of the positioning member 6 is inserted into the opening 7110 of the connection part 71 of the distribution pipe 7 in a direction intersecting the axial direction of the connection part 71 of the distribution pipe 7. The opening 7110 of the connection part 71 of the distribution pipe 7 may be a notch sunk from an end face of the connection part 71. The positioning member 6 may have a rectangular, circular or trapezoidal cross section.

Referring to FIGS. 2, 13, 14, 16, 17, 18, 19, 21, 22, 24 and 25, according to embodiments of the present invention, the connection part 71 of the distribution pipe 7 comprises a first connection part 711 extending in the axial direction of the distribution pipe 7.

Referring to FIGS. 8, 9 and 11, according to embodiments of the present invention, the connection part 71 of the distribution pipe 7 comprises a first connection part 711 extending in the axial direction of the distribution pipe 7, and a second connection part 712 which is connected to the first connection part 711 and bent at a predetermined angle (for example, 90 degrees) relative to the first connection part 711; and the first end 61 of the positioning member 6 is connected to the second connection part 712 of the connection part 71 of the distribution pipe 7. The positioning member 6 also has an intermediate part 63 between the first end 61 and the second end 62, and the second end 62 of the positioning member 6 has a bent part 64 which is bent at a predetermined angle relative to the intermediate part 63 of the positioning member 6, the bent part 64 being engaged in the opening or recess 8101 of the header wall 810 of the header 81.

Figure 3:
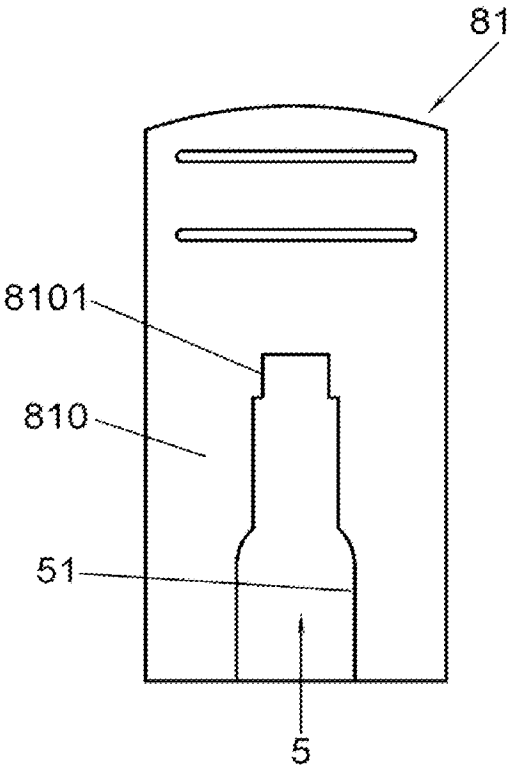
FIG. 3 is a schematic partial enlarged right view of the header of the heat exchanger shown in FIG. 1.
Figure 6:
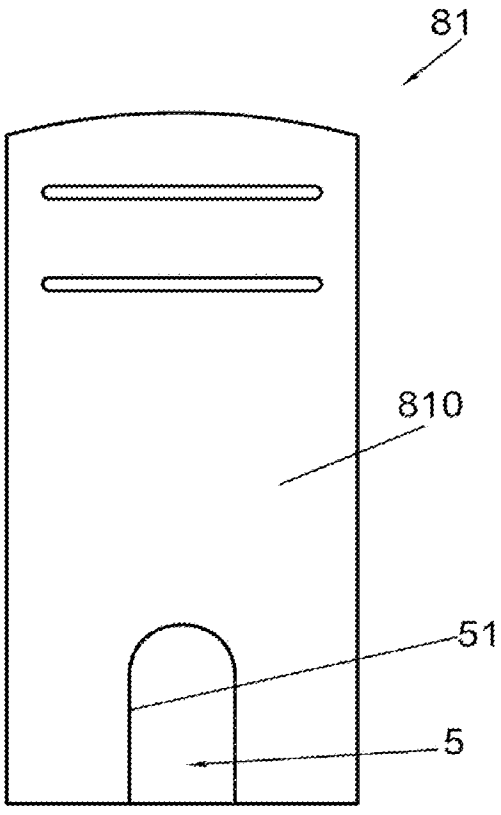
FIG. 6 is a schematic partial enlarged right view of the header of the heat exchanger shown in FIG. 4 according to an embodiment of the present invention.
Figure 5:
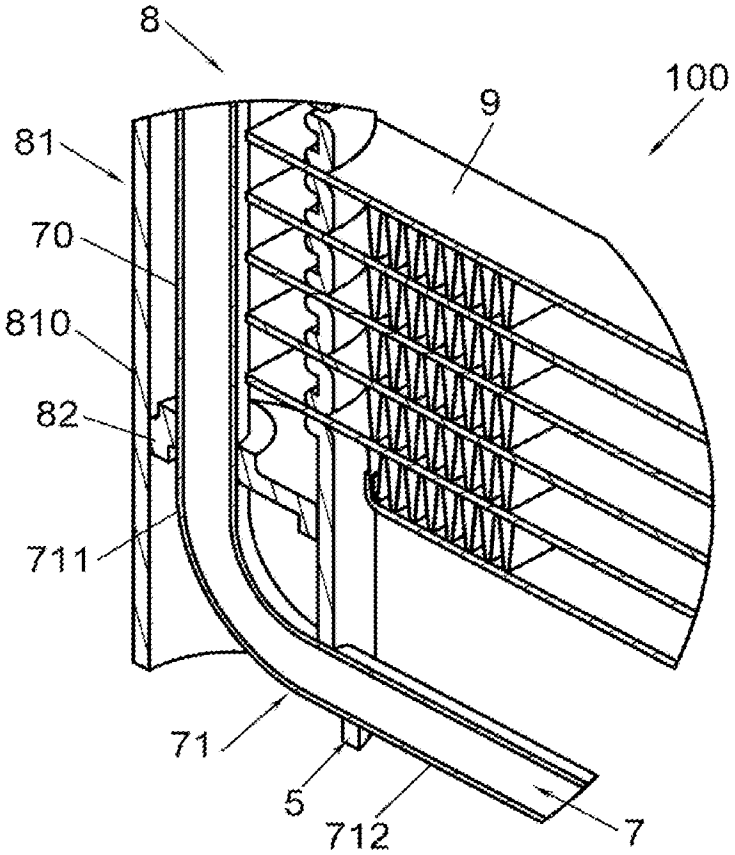
FIG. 5 is a schematic partial enlarged sectional view of the heat exchanger shown in FIG. 4.

Referring to FIGS. 1 to 7, according to embodiments of the present invention, the connection part 71 of the distribution pipe 7 comprises a first connection part 711 extending in the axial direction of the distribution pipe 7, and a second connection part 712 which is connected to the first connection part 711 and bent at a predetermined angle (for example, 90 degrees) relative to the first connection part 711; and the header 81 further comprises a slot 5 penetrating the header wall 810 at the end of the header wall 810, the slot 5 comprising a first slot part 51 sunk from the end face of the end of the header wall 810, and the second connection part 712 of the distribution pipe 7 is in the first slot part 51. Referring to FIG. 3, the opening or recess 8101 of the header wall 810 may be a notch sunk from the first slot part 51 in the header wall 810 in a direction away from the end face of the end of the header wall 810. The distribution pipe 7 may not be in contact with a wall of the slot 5. Lengthening the header so that the distribution pipe is located in the slot 5 may have the effect of protecting the distribution pipe. The distribution pipe may be positioned by means of the positioning member 6. The distribution pipe may also be engaged in the slot 5, to provide further positioning for the distribution pipe.

Figure 7:
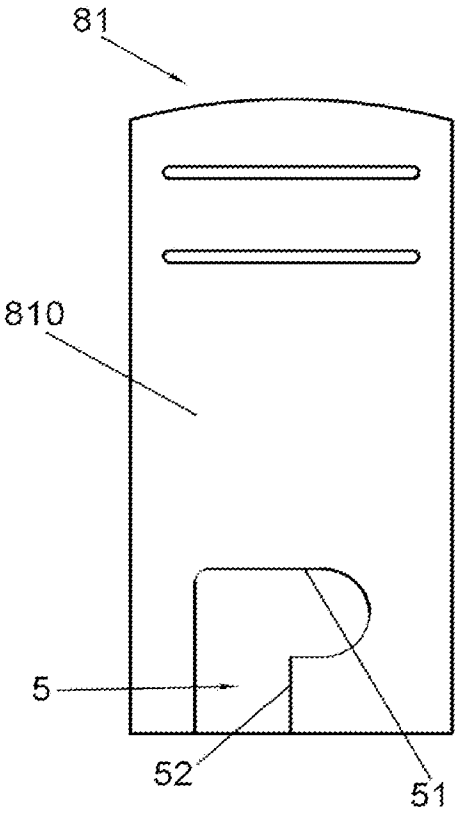
FIG. 7 is a schematic partial enlarged right view of the header of the heat exchanger shown in FIG. 4 according to another embodiment of the present invention.

Referring to FIGS. 1 to 7, in particular FIG. 7, according to embodiments of the present invention, the connection part 71 of the distribution pipe 7 comprises a first connection part 711 extending in the axial direction of the distribution pipe 7, and a second connection part 712 which is connected to the first connection part 711 and bent at a predetermined angle (for example, 90 degrees) relative to the first connection part 711; and the header 81 further comprises a slot 5 penetrating the header wall 810 at the end of the header wall 810, the slot 5 comprising a first slot part 51 and a second slot part 52; the second slot part 52 is sunk from the end face of the end of the header wall 810, and the first slot part 51 extends in a direction intersecting the second slot part 52 (e.g. a direction perpendicular to the second slot part 52) from that end of the second slot part 52 which is remote from the end face of the end of the header wall 810; the first slot part 51 has slot walls opposite each other in the axial direction of the header 81, and the second connection part 712 of the distribution pipe 7 is in the first slot part 51. Referring to FIG. 3, the opening or recess 8101 of the header wall 810 is a notch sunk from the second slot part 52 in the header wall 810 in a direction away from the end face of the end of the header wall 810. In the embodiment shown in FIGS. 4 to 6, there is no positioning member 6; the distribution pipe is engaged in the slot 5, and the slot 5 serves a positioning function and also serves to protect the distribution pipe. In addition, providing the first slot part 51 and the second slot part 52 may facilitate the insertion of one end of the positioning member 6 into the opening or recess of the header.

By using the header assembly and the heat exchanger according to the embodiments of the present invention, the quality of the heat exchanger may be improved.

In the header assembly and the heat exchanger according to the embodiments of the present invention, since the positioning member is provided between the distribution pipe and the header, the installation position of the distribution pipe is pre-fixed by means of the positioning member when the distribution pipe is installed. During the process of putting the heat exchanger in a furnace and brazing it, due to the action of the positioning member, the distribution pipe will not experience positional deflection even if it is affected by high temperature and gravity, thereby improving the installation precision of the distribution pipe and improving the heat exchange performance.

Although the above embodiments have been described, certain features in the above embodiments may be combined to form new embodiments.

The invention claimed is:

1. A header assembly for a heat exchanger, comprising:

a header, comprising: a header wall, and a recess on the header wall or an opening penetrating the header wall at an end of the header wall;

an end cap disposed at the end of the header wall to close the end of the header, the end cap having a hole, the opening or recess being at a side of the end cap that faces an end face of the end of the header wall;

a distribution pipe, comprising a distribution part and a connection part, the connection part projecting from the end cap through the hole of the end cap from the distribution part; and a positioning member, the positioning member having a first end and a second end, the first end of the positioning member being connected to the connection part of the distribution pipe, and the second end of the positioning member being engaged in the opening or recess of the header wall of the header.

2. The header assembly for a heat exchanger as claimed in claim 1, wherein:

the first end of the positioning member has a hole or a notch, and the connection part of the distribution pipe is inserted into the hole or notch of the first end of the positioning member.

3. The header assembly for a heat exchanger as claimed in claim 1, wherein:

the opening or recess of the header wall is a notch sunk from the end face of the end of the header wall.

4. The header assembly for a heat exchanger as claimed in claim 1, wherein:

the positioning member extends in a direction intersecting the axial direction of the header.

5. The header assembly for a heat exchanger as claimed in claim 1, wherein:

the connection part of the distribution pipe has an opening penetrating a pipe wall of the connection part, and the first end of the positioning member is inserted into the opening of the connection part of the distribution pipe in a direction intersecting the axial direction of the connection part of the distribution pipe.

6. The header assembly for a heat exchanger as claimed in claim 5, wherein:

the opening of the connection part of the distribution pipe is a notch sunk from an end face of the connection part.

7. The header assembly for a heat exchanger as claimed in claim 1, wherein:

the connection part of the distribution pipe comprises a first connection part extending in the axial direction of the distribution pipe, and a second connection part which is connected to the first connection part and bent at a predetermined angle relative to the first connection part, and the first end of the positioning member is connected to the second connection part of the connection part of the distribution pipe.

8. The header assembly for a heat exchanger as claimed in claim 7, wherein:

the positioning member also has an intermediate part between the first end and the second end, and the second end of the positioning member has a bent part which is bent at a predetermined angle relative to the intermediate part of the positioning member, the bent part being engaged in the opening or recess of the header wall of the header.

9. The header assembly for a heat exchanger as claimed in claim 1, wherein:

the connection part of the distribution pipe comprises a first connection part extending in the axial direction of the distribution pipe, and a second connection part which is connected to the first connection part and bent at a predetermined angle relative to the first connection part, and the header further comprises a slot penetrating the header wall at the end of the header wall, the slot comprising a first slot part sunk from the end face of the end of the header wall, and the second connection part of the distribution pipe is in the first slot part.

10. The header assembly for a heat exchanger as claimed in claim 1, wherein:

the connection part of the distribution pipe comprises a first connection part extending in the axial direction of the distribution pipe, and a second connection part which is connected to the first connection part and bent at a predetermined angle relative to the first connection part, and the header further comprises a slot penetrating the header wall at the end of the header wall, the slot comprising a first slot part and a second slot part; the second slot part is sunk from the end face of the end of the header wall, and the first slot part extends in a direction intersecting the second slot part from that end of the second slot part which is remote from the end face of the end of the header wall; the first slot part has slot walls opposite each other in the axial direction of the header, and the second connection part of the distribution pipe is in the first slot part.

11. The header assembly for a heat exchanger as claimed in claim 9, wherein:

the opening or recess of the header wall is a notch sunk from the first slot part in the header wall in a direction away from the end face of the end of the header wall.

12. The header assembly for a heat exchanger as claimed in claim 10, wherein:

the opening or recess of the header wall is a notch sunk from the second slot part in the header wall in a direction away from the end face of the end of the header wall.

13. The header assembly for a heat exchanger as claimed in claim 2, wherein:

the connection part of the distribution pipe comprises a first connection part extending in the axial direction of the distribution pipe, and a second connection part which is connected to the first connection part and bent at a predetermined angle relative to the first connection part, and the first end of the positioning member is connected to the second connection part of the connection part of the distribution pipe.

14. The header assembly for a heat exchanger as claimed in claim 3, wherein:

the connection part of the distribution pipe comprises a first connection part extending in the axial direction of the distribution pipe, and a second connection part which is connected to the first connection part and bent at a predetermined angle relative to the first connection part, and the first end of the positioning member is connected to the second connection part of the connection part of the distribution pipe.

15. The header assembly for a heat exchanger as claimed in claim 2, wherein:

the connection part of the distribution pipe comprises a first connection part extending in the axial direction of the distribution pipe, and a second connection part which is connected to the first connection part and bent at a predetermined angle relative to the first connection part, and the header further comprises a slot penetrating the header wall at the end of the header wall, the slot comprising a first slot part sunk from the end face of the end of the header wall, and the second connection part of the distribution pipe is in the first slot part.

16. The header assembly for a heat exchanger as claimed in claim 2, wherein:

the connection part of the distribution pipe comprises a first connection part extending in the axial direction of the distribution pipe, and a second connection part which is connected to the first connection part and bent at a predetermined angle relative to the first connection part, and the header further comprises a slot penetrating the header wall at the end of the header wall, the slot comprising a first slot part and a second slot part; the second slot part is sunk from the end face of the end of the header wall, and the first slot part extends in a direction intersecting the second slot part from that end of the second slot part which is remote from the end face of the end of the header wall; the first slot part has slot walls opposite each other in the axial direction of the header, and the second connection part of the distribution pipe is in the first slot part.

17. A heat exchanger, comprising:

a heat exchange tube; and the header assembly as claimed in claim 1, an end of the heat exchange tube being connected to the header of the header assembly.

* * * * *